US006481450B2

(12) United States Patent
Chen

(10) Patent No.: US 6,481,450 B2
(45) Date of Patent: Nov. 19, 2002

(54) HANDLE MECHANISM FOR AN AUTOMATIC MULTIPLE-FOLDED UMBRELLA

(75) Inventor: Tien-Cheng Chen, Changhua Hsien (TW)

(73) Assignee: Ming Ho Umbrella Industry Co., Ltd., Changhua Hsien (TW)

( * ) Notice: Subject to any disclaimer, the term of this patent is extended or adjusted under 35 U.S.C. 154(b) by 0 days.

(21) Appl. No.: 09/808,052

(22) Filed: Mar. 15, 2001

(65) Prior Publication Data

US 2002/0129842 A1 Sep. 19, 2002

(51) Int. Cl.[7] ..... A45B 25/14

(52) U.S. Cl. ..... 135/24; 135/22; 135/15.1; 135/20.3; 135/25.4; 135/25.41; 135/28

(58) Field of Search ..... 135/22, 24, 15.1, 135/20.3, 25.1, 28, 25.4, 25.41

(56) References Cited

U.S. PATENT DOCUMENTS

| | | | | |
|---|---|---|---|---|
| 5,178,174 A | * | 1/1993 | Wu | 135/22 |
| 5,247,955 A | * | 9/1993 | Wu | 135/22 |
| 5,626,160 A | * | 5/1997 | Ko | 135/22 |
| 5,632,290 A | * | 5/1997 | Ling Kuo | 135/24 |
| 5,803,102 A | * | 9/1998 | Ko | 135/22 |
| 6,145,522 A | * | 11/2000 | Ko | 135/24 |

FOREIGN PATENT DOCUMENTS

| | | | |
|---|---|---|---|
| DE | 29914354 U1 | * | 10/1999 |
| EP | 151847 A1 | * | 2/1984 |

* cited by examiner

*Primary Examiner*—Janet M. Wilkens
*Assistant Examiner*—John Fitzgerald
(74) *Attorney, Agent, or Firm*—Bacon & Thomas

(57) ABSTRACT

A handle mechanism of an automatic folding umbrella which comprises body edges two sides of which are installed with a first spring, respectively, and a guiding track, respectively; further, a penetrating hole being formed at the center of the body; a stop being inserted into the body from a lower side; a center thereof being installed with a stopping portion; a retaining piece being inserted into the body from a lower side thereof; and a center thereof being installed with a retainer; a lower cover covering the stop and the retaining piece to be in the body; a button being installed above and at two lateral walls of the body; an inner edge thereof being installed with a downward protruded press portion; a post being inserted into the penetrating hole of the body; a movable toggle being placed in the body; two sides of the movable toggle being protruded with bosses and being installed with a fourth spring; a folding block with an inverse L shape is formed between two extending pieces at the upper end of the movable toggle; and a fifth spring being installed between the movable toggle and the folding block. By the aforesaid structure, an automatic multiple folded umbrella occupying a less space is formed.

5 Claims, 7 Drawing Sheets

HANDLE MECHANISM FOR AN AUTOMATIC MULTIPLE-FOLDED UMBRELLA

BACKGROUND OF THE INVENTION

The present invention relates to an automatic multiple folded umbrella, which can be stored and expanded automatically for being used.

In many area, umbrellas are necessary in rainy day, while since to carry an umbrella out is very inconvenient, it is very often that the umbrella is left somewhere carelessly after the whether become clear. However, in next time as it is rainy, the user will regret for not taking an umbrella.

In general, the umbrellas are designed to be expanded easily, while it is difficult to fold it. In rainy day, as the user enters into a car, the user needs to receive an umbrella by two hands, however, this is inconvenient, and it is very possible that the body of the user will become wet and finally the chairs in the car is also wetted.

Therefore, there is an eager demand for a novel design of an umbrella which can be folded easily and conveniently so as to be received in a pocket, and then be taken out conveniently. If it is desired to receive the umbrella, the user is only necessary to operate it by one hand. As a result, the aforesaid defects in the prior art design is improved.

SUMMARY OF THE INVENTION

Accordingly, the primary object of the present invention is to provide an automatic multiple folded umbrella which only occupies a small space and can be carried out easily.

To achieve the above objective the present invention provides an automatic multiple folded umbrella comprising a body at edges of two sides of which are installed with a first spring, respectively, and a guiding track, respectively; further, a penetrating hole being formed at the center of the body; a stop being inserted into the body from a lower side; a center thereof being installed with a stopping portion; a retaining piece being inserted into the body from a lower side thereof; and a center thereof being installed with a retainer; a lower cover covering the stop and the retaining piece so as to be in the body; a button being installed above and at two lateral walls of the body; an inner edge thereof being installed with a downward protruded press portion; a post being inserted into the penetrating hole of the body; a movable toggle being placed in the body; two sides of the movable toggle being protruded with bosses and being installed with a fourth spring; a folding block with an inverse L shape is formed between two extending pieces at the upper end of the movable toggle; and a fifth spring being installed between the movable toggle and the folding block. By the aforesaid structure, an automatic multiple folded umbrella occupying a less space is formed.

The various objects and advantages of the present invention will be more readily understood from the following detailed description when read in conjunction with the appended drawing.

DETAILED DESCRIPTION OF THE PREFERRED EMBODIMENTS

Figure 1:
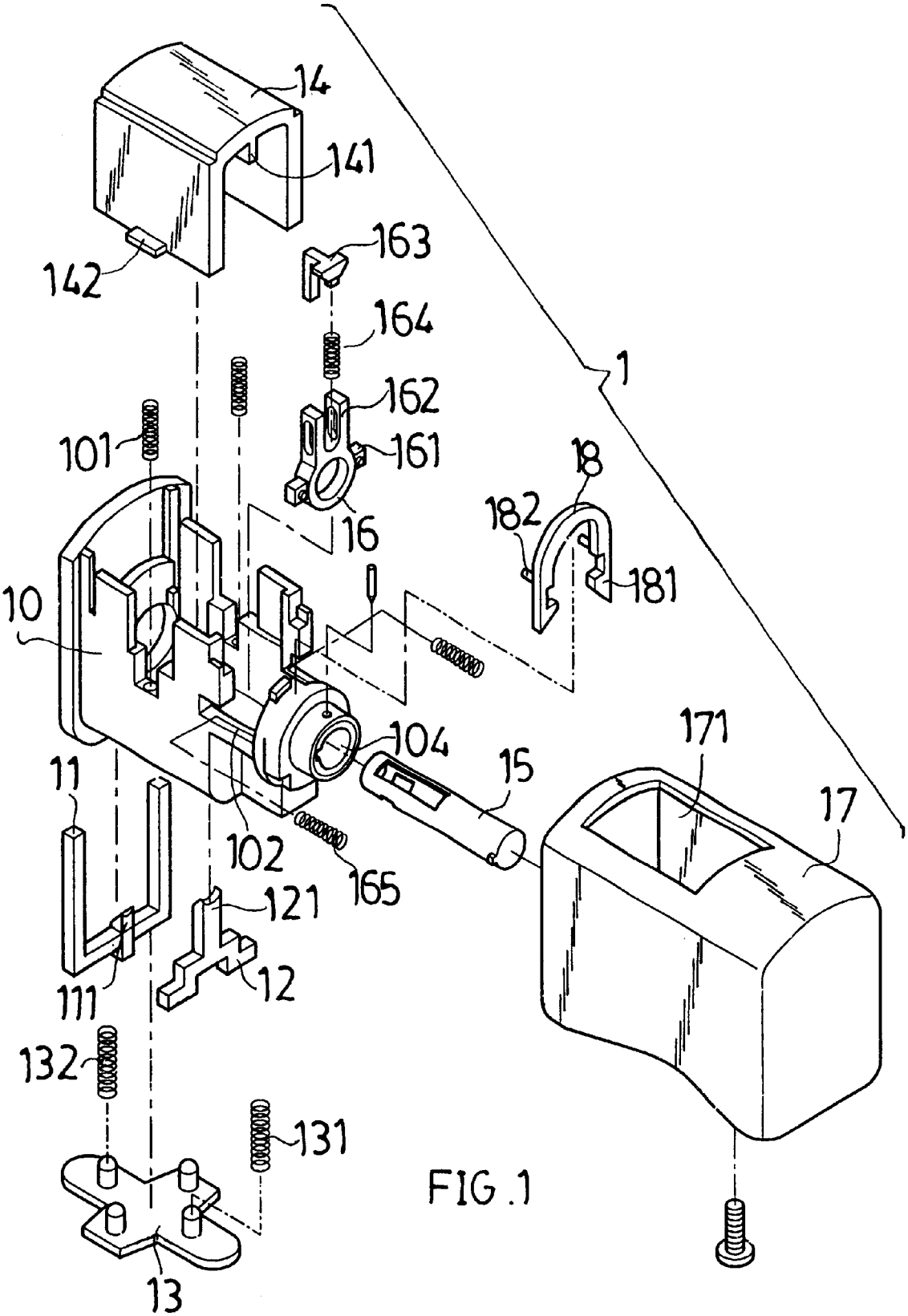
FIG. 1 is a partial exploded view of the shaft of the present invention.
Figure 2:
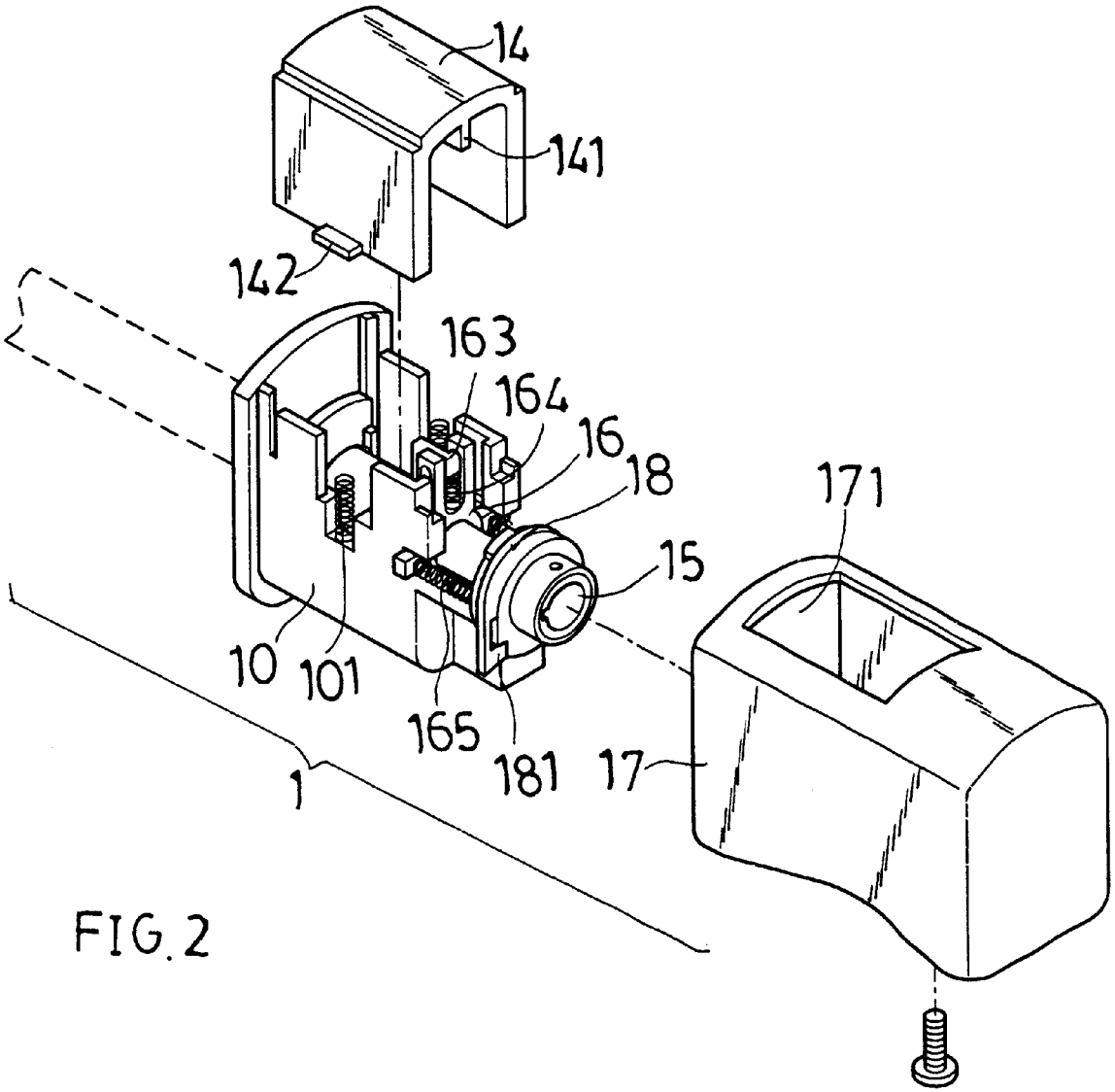
FIG. 2 is a partial assembly view of the shaft of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4B, in the present invention, a tube 3 is installed between the shaft 1 and the rib 2.

The shaft 1 includes the following components.

A body 10 is a hollow solid body with an opening facing upwards. At the edges of two sides thereof are installed with a first spring 101, respectively, and a guiding track 102, respectively. Further, a penetrating hole 104 is formed at the center of the body 10.

A stop 11 has a "∪" shape and is inserted into the body 10 from the lower side. The center thereof is installed with a stopping portion 111. The edge of the top of the stopping portion 111 is formed like a cambered shape.

A retaining piece 12 has a ladder shape and is inserted into the body 10 from the lower side thereof. The center thereof is installed with a retainer 121. The edge of the top thereof is formed like a cambered shape and one end thereof is slightly inclined.

A lower cover 13 cover the stop 11 and the retaining piece 12 to be in the body 10. A second spring 131 and a third spring 132 are installed between the lower cover 13 and the stop 11 and retaining piece 12. The elastic forces of the springs 131 and 132 have the functions of restoring the stop 11 and the retaining piece 12.

A button 14 has a ∩ shape and is installed above and at two lateral walls of the body 10. The inner edge thereof is installed with a downward protruded press portion 141. Two lateral walls of the press portion 141 are protruded with a project 142, respectively, for pressing the first spring 101.

A post 15 is inserted into the penetrating hole 104 of the body 10.

A movable toggle 16 is placed in the body 10, and is slidable in the guiding track 102. Two sides of the movable toggle 16 are protruded with bosses 161 and are installed with a fourth spring 165. The movable toggle 16 is moved along the guiding track 102 with the elastic force of the fourth spring 165. A folding block 163 with an inverse L shape is formed between two extending pieces 162 at the upper end of the movable toggle 16. Furthermore, a fifth spring 164 is installed between the movable toggle 16 and the folding block 163. By the fifth spring 164, the folding block 163 can be restored rapidly.

A housing 17 has an opening facing leftwards for covering the body 10 and then they are locked as an integral body for confining the abovesaid elements. A window 171 is formed at the upper side of the housing 17.

A buckling ring 18 has a shape like a horse's hoof and a hook leg 181 is installed at an opening end for being buckled to the body 10. The buckling ring 18 is a post 182 at one lateral edge for being buckled to another end of the fourth spring 165.

A rib 2 has a plurality of frames 21. Each frame 21 has a sixth spring 22. The elastic force of the sixth spring 22 serves to cause the rib 2 to support the umbrella rapidly. Another end of the frame 21 is connected to an upper nest 23 and a lower nest 24. A winding rope 25 is installed between the upper nest 23 and the lower nest 24.

One end of the rope 25 is installed with a buckling head 26. By the rope 25, the upper nest 23 and lower nest 24 may displace with respective to one another.

A tube 3 is in the lower nest 24 and is installed by an outer tube 31, a second middle tube 32, a second middle tube 33 and an inner tube 34. The inner tube 34 is inserted into the penetrating hole 104 of the body 10. By the post 15, it is firmly secured to the body 10. The outer tube 31 has an inserting hole 311 for being buckled by the stopping portion 111 of the stop 11 and a restoring spring 35 is installed in the tube 3.

The present invention is formed by abovesaid structure. In general, the umbrella is disposed as a storing condition like that shown in FIG. 3A. If it is desired to be used, the button 14 is pressed so that the stop 11 is pressed and thus the stopping portion 111 will release from the inserting hole 311 of the outer tube 31. By the restoring spring 35, the lower nest 24 will be resilient back to the upper nest 23. Meanwhile, the sixth spring 22 will open the frames 21 (opening the umbrella, referring to FIG. 3B). Meanwhile, the movable toggle 16 is displaced to be below the press portion 141.

Figure 3A:
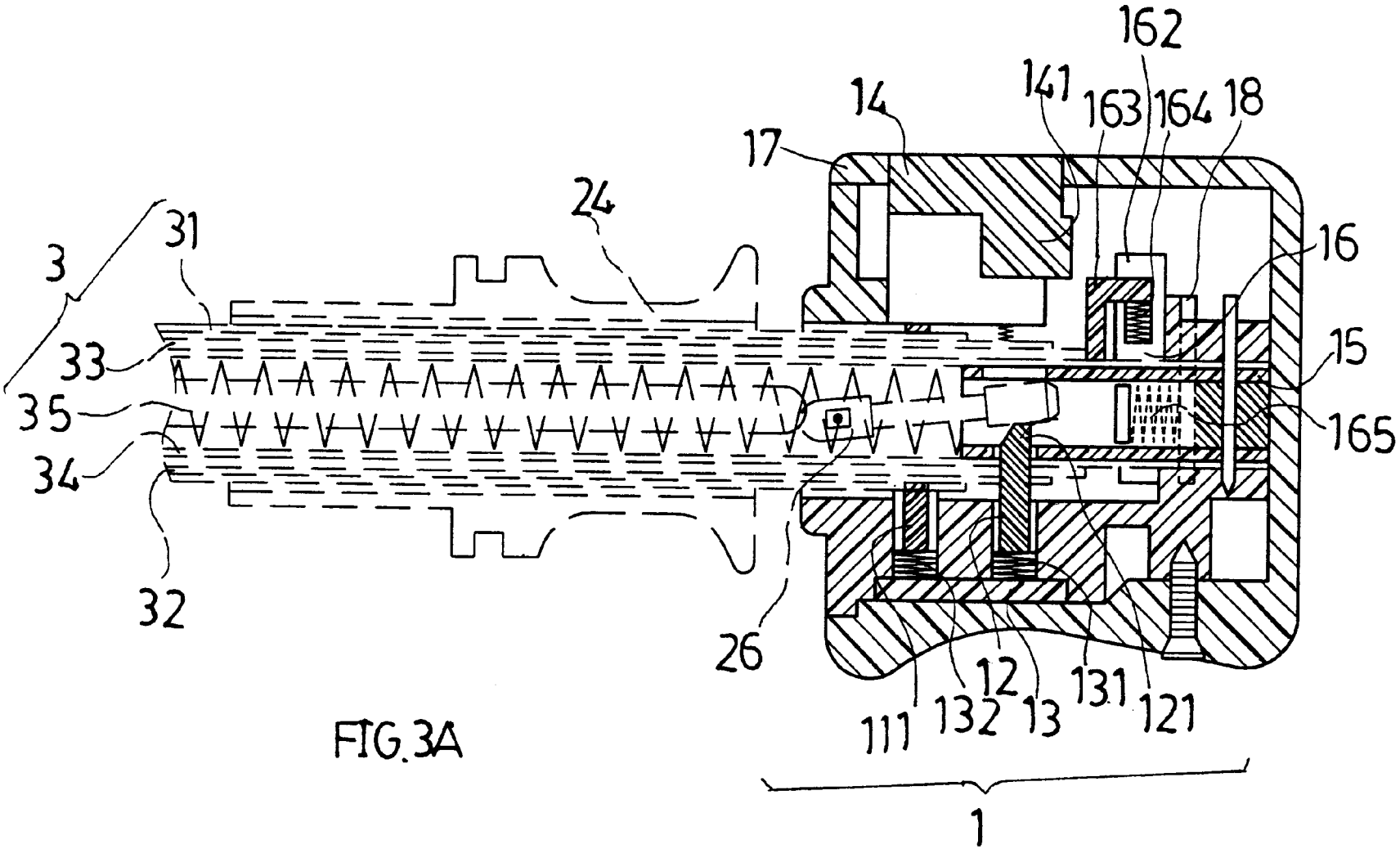
FIG. 3A is a schematic view showing the inner structure of the shaft of the present invention.
Figure 3B:
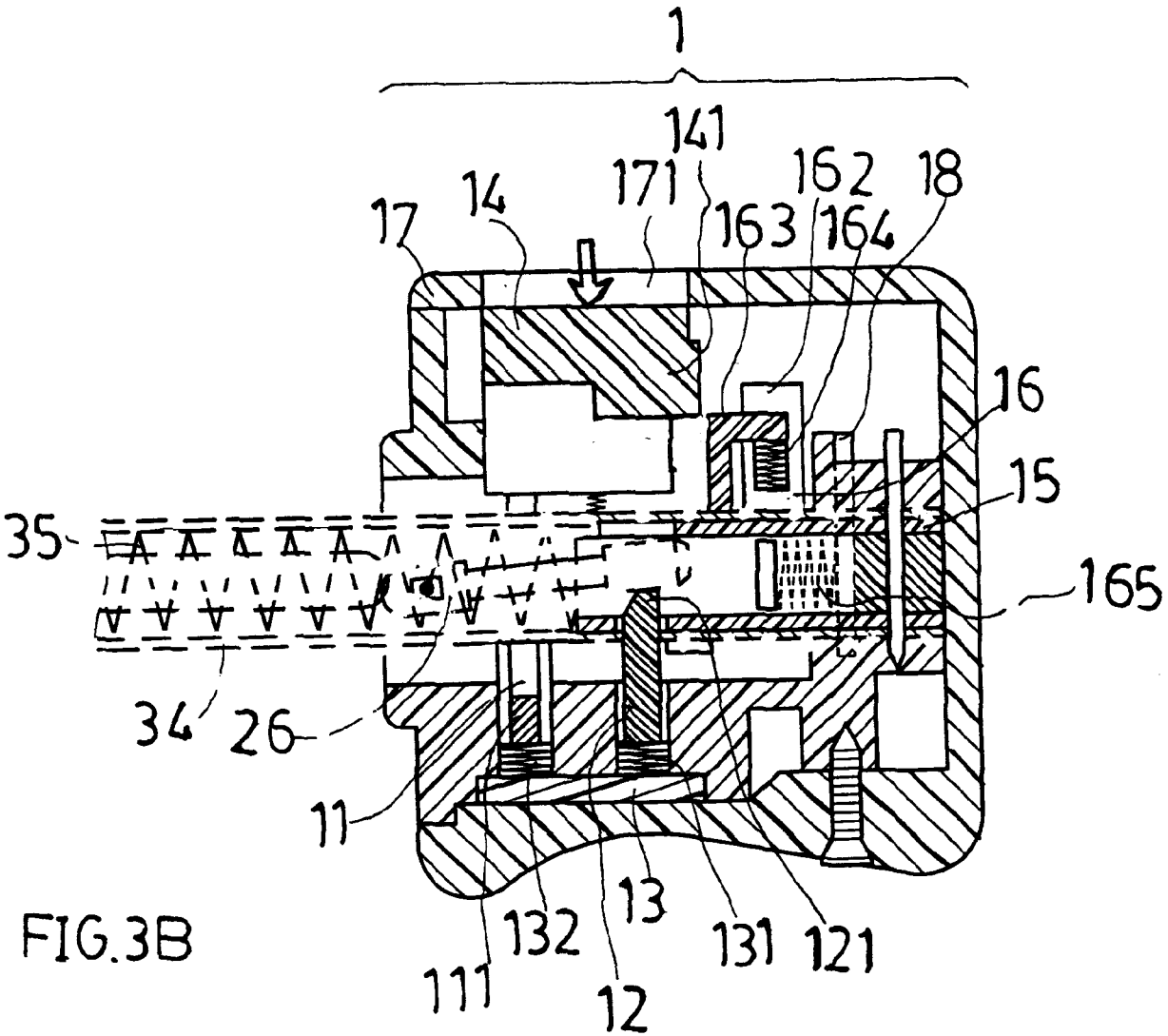
FIG. 3B is a schematic view showing the operation of FIG. 3A.
Figure 3C:
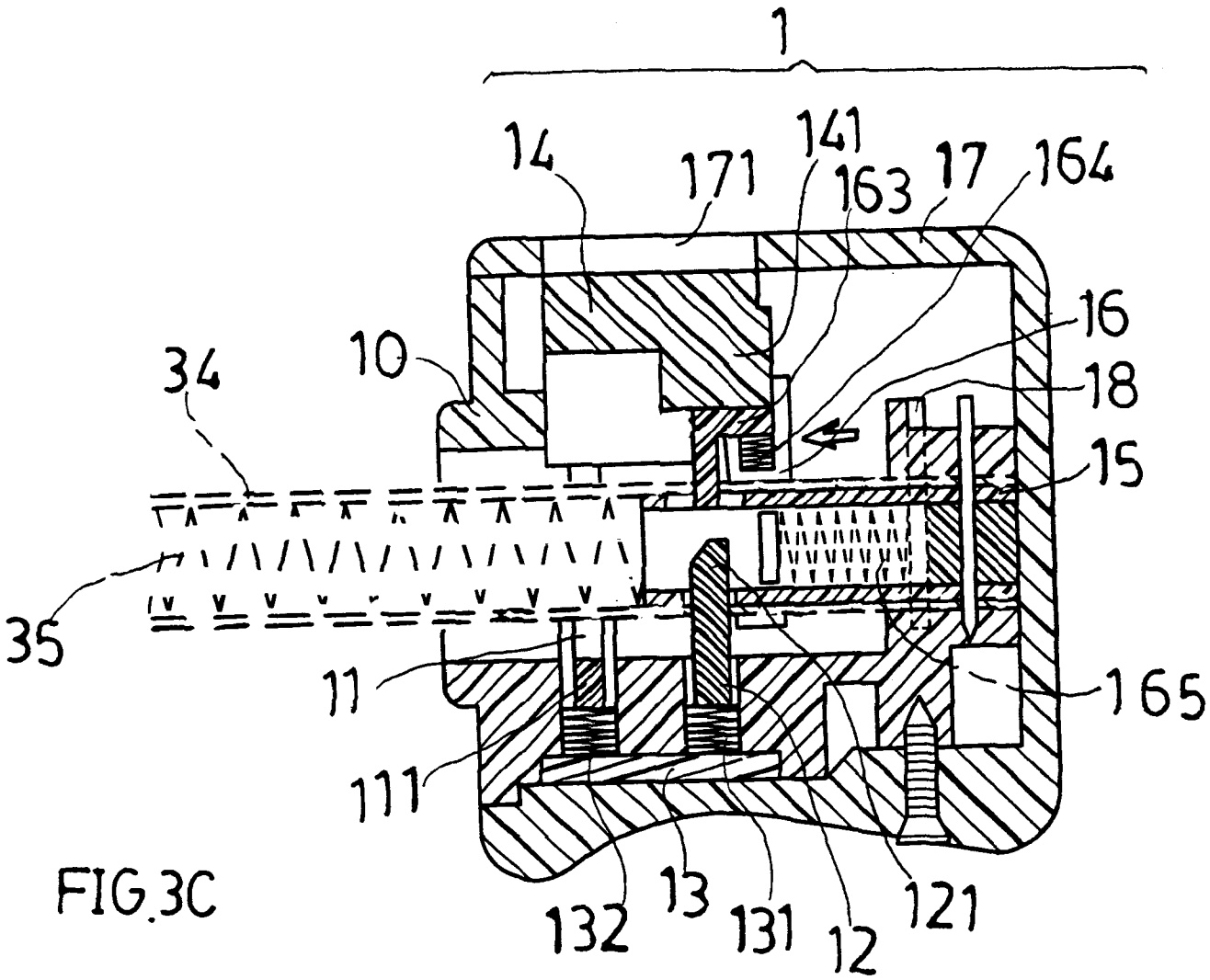
FIG. 3C is another schematic view showing the operation of FIG. 3B.
Figure 4A:
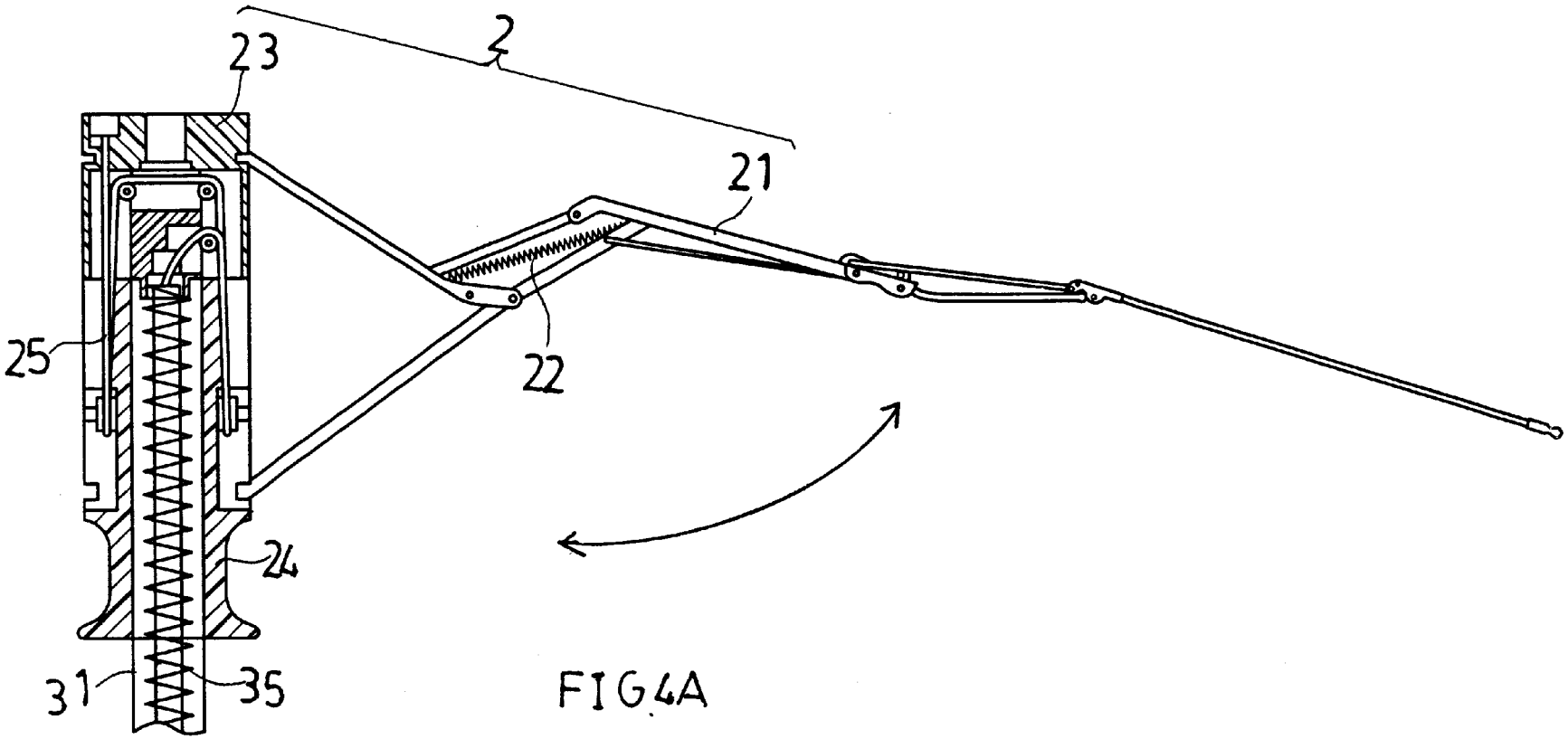
FIG. 4A is a schematic view showing the structure of the rib in the present invention.
Figure 4B:
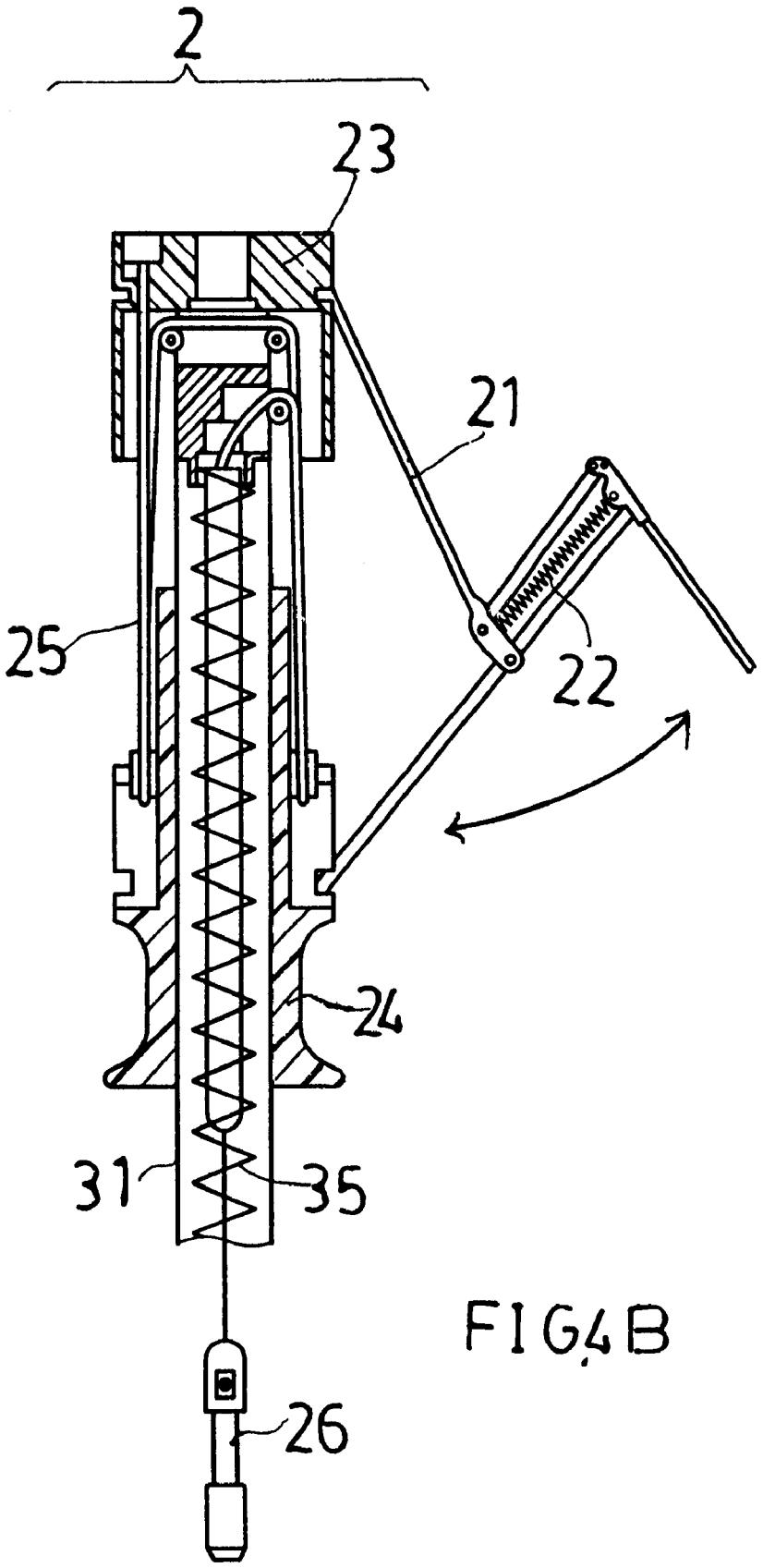
FIG. 4B is a schematic view showing the operation of FIG. 4A.

Then, as the umbrella is required to be stored, the user may enter into a car, and then the user presses the button 14 by only one hand so that the folding block 163 will resist against the buckling head 26 and the retaining piece 12 so that the head 26 releases from the retainer 121 (referring to FIG. 3C). Then, the rope 25 is released and thus the frames 21 are folded (referring to FIG. 4B). Thus, the umbrella is received into the car. Then, by two hands, the top of the umbrella is pressed so that the lower nest 24 moves approach to the shaft 1 so that the outer tube 31 can be inserted into the body 10 again (referring to FIG. 3A). Meanwhile, the stopping portion 111 will buckle the inserting hole 311 again and the movable toggle 16 will be pressed to be restored to the original position. Furthermore, the retaining piece 12 will buckle the head 26 again. Therefore, the umbrella is received with only a small volume so as to be placed in a pocket to be carried conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handle mechanism of an automatic multiple folded umbrella comprising:

a body being a hollow solid body with an opening facing upwards; at edges of two sides thereof being installed with a first spring, respectively, and a guiding track, respectively; and a penetrating hole being formed at a center of the body;

a stop having a ∪ shape and being inserted into the body from a lower side; and a center thereof being installed with a stopping portion;

a retaining piece having a ladder shape and being inserted into the body from a lower side thereof; and a center thereof being installed with a retainer;

a lower cover covering the stop and the retaining piece to be in the body;

a button having an inverted ∪ shape and being installed above and at two lateral walls of the body; and an inner edge thereof being installed with a downward protruded press portion;

a post being inserted into the penetrating hole of the body; and a movable toggle being placed in the body, slidably in the track; two sides of the movable toggle being protruded with bosses and being installed with a fourth spring; a folding block with an inverse L shape being formed between two extending pieces at the upper end of the movable toggle; and a fifth spring being installed between the movable toggle and the folding block.

2. The automatic multiple folded umbrella as claimed in claim 1, wherein said first spring is installed at edges of two lateral walls of the body and two lateral walls of the button are protruded with projects for pressing the first spring.

3. The automatic multiple folded umbrella as claimed in claim 1, wherein a second spring and a third spring are installed between the lower cover and the stop and retaining piece.

4. The automatic multiple folded umbrella as claimed in claim 1, wherein a housing is installed out of the body for covering the body and then they are locked as an integral body for confining the said elements and a window is formed at the upper side of the housing.

5. The automatic multiple folded umbrella as claimed in claim 1, wherein a buckling ring is installed in the body, and a hook leg is installed at an opening end for being buckled to the body; the buckling ring has a post at one lateral edge for being buckled to another end of the fourth spring.

* * * * *